US005533838A

United States Patent [19]

Kundel

[11] Patent Number: 5,533,838

[45] Date of Patent: Jul. 9, 1996

[54] MODULAR TRENCH BOX SHEETING

[76] Inventor: Robert Kundel, P.O. Box 4210, Warren, Ohio 44482

[21] Appl. No.: 421,516

[22] Filed: Apr. 13, 1995

[51] Int. Cl.[6] ..... E21D 5/00; E21D 5/06

[52] U.S. Cl. ..... 405/282; 405/276

[58] Field of Search ..... 405/282, 283, 405/272, 149, 276, 279

[56] References Cited

U.S. PATENT DOCUMENTS

| | | | |
|---|---|---|---|
| 3,584,465 | 6/1971 | Holl | 405/279 |
| 3,729,938 | 5/1973 | Morrice | 405/282 |
| 3,937,026 | 2/1976 | Krings | 405/282 |
| 4,059,964 | 11/1977 | Pavese | 405/282 |
| 4,274,763 | 6/1981 | Krings | 405/272 X |
| 4,376,599 | 3/1983 | Krings | 405/282 |
| 4,487,530 | 12/1984 | Morrice | 405/282 |

*Primary Examiner*—Stephen J. Novosad
*Attorney, Agent, or Firm*—Harpman & Harpman

[57] ABSTRACT

A method and apparatus for constructing modular trench box sheeting panels for use in wall supporting during the excavation of trenches or the like. A rectangular support frame is formed by a pair of sheeting support members secured to one another by pairs of spreader members at oppositely disposed ends thereof. The box sheeting panels of the invention are formed of modular interdependent structural shapes that are assembled in a modular fabrication method to form interengageable adjustable wall sheeting panel members with reinforced pounding plates and ground engaging knife edges.

7 Claims, 2 Drawing Sheets

MODULAR TRENCH BOX SHEETING

BACKGROUND OF THE INVENTION

1. Technical Field

The present invention relates to ditch shoring construction that is generally consisting of horizontal support frames and multiple vertically positioned wall sheeting panels to shore up a wall during ditch excavation.

2. Description of Prior Art

Prior art devices of this type have been directed to trench box and wall sheeting systems that use multiple abutting and overlapping wall sheeting panels and support frame to provide temporary shoring of an excavated trench wall. Typically, the support frame is positioned on the ground and the multiple wall sheeting panels are then driven into the ground guided by the support frame in side to side abutting relationship. The material between the wall sheeting panels thus positioned is then progressively excavated defining a trench within the supporting frame and wall sheeting area, see for example U.S. Pat. Nos. 4,487,530, 4,376,599, 4,059,964, 3,729,938 and 3,584,465.

In U.S. Pat. No. 4,487,530 a method and apparatus for shoring a trench is disclosed wherein a horizontal whaling frame is positioned between sheet members after they have been driven into the ground.

U.S. Pat. No. 4,376,599 is directed to a ditch shoring unit having a horizontal frame having transversely adjustable girders with guide heads and pile driving panels having cross-sectionally waved shape that are secured to the frame members by multiple guide heads.

A sheeting installation system is disclosed in U.S. Pat. No. 4,059,964 wherein a rectangular frame is formed by framing panels, with a plurality of wall sheeting support panels positioned within the frame.

U.S. Pat. No. 3,729,938 is directed to a trench shoring frame having sidewalls with a plurality of vertically disposed plates movable connected to one another and said shoring frame.

U.S. Pat. No. 3,584,465 discloses a rectangular bracing frame used to guide sheeting members that are to be driven vertically into the ground.

SUMMARY OF THE INVENTION

A modular construction method and apparatus for trench box sheeting that is used to support the walls during a trench excavation. The method is directed to assembly of multiple components into a box panel that has a reinforced pounding plate and ground engaging knife edges with simplified welding and internal fabrication components.

DESCRIPTION OF THE DRAWINGS

FIG. 3 is an enlarged perspective view of an assembled sheeting panel of the invention;

DESCRIPTION OF THE PREFERRED EMBODIMENT

Figure 1:
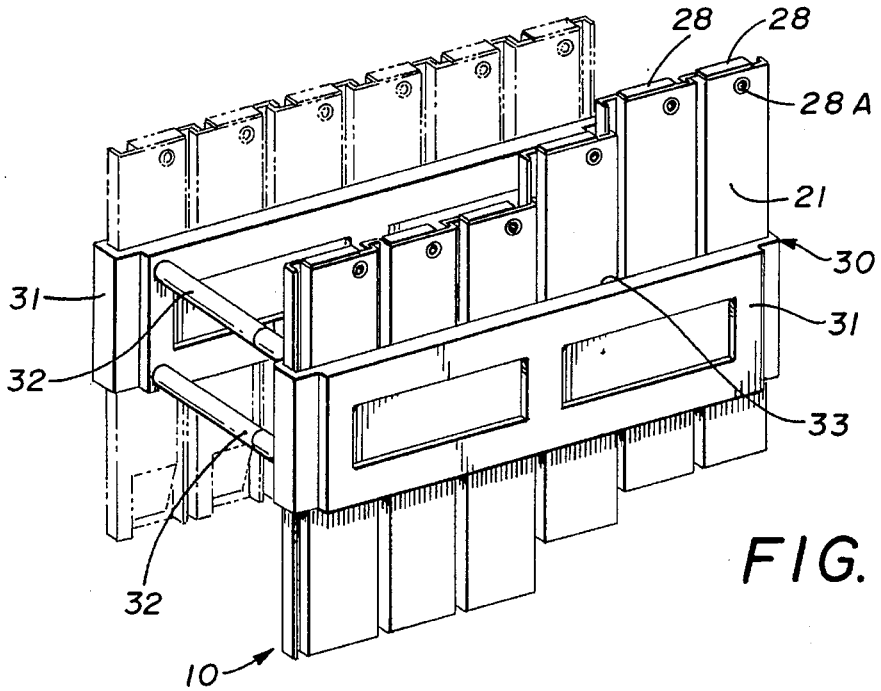
FIG. 1 is a perspective view of installation of the invention.

Referring to FIGS. 2–6 of the drawings, a sheeting panel 10 can be seen comprising a generally elongated rectangular base support element 11 having oppositely disposed upstanding longitudinally extending sides 12 and 13 and respective ends 14 and 15. A plurality of upstanding reinforced plates 16 are secured in spaced transverse relation to one another on the base support element 11 inwardly from the end 14. A center support angle 17 is secured to the base supporting element 11 inwardly from the end portion 14 between said reinforcing plates 16 and extends longitudinally the length of the base support element 11 between respective ends 14 and 15.

Figure 4:
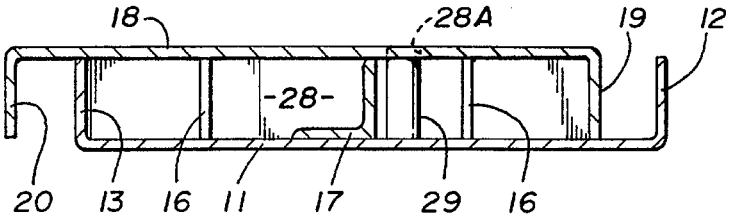
FIG. 4 is a section on lines 4—4 of FIG. 5.
Figure 5:
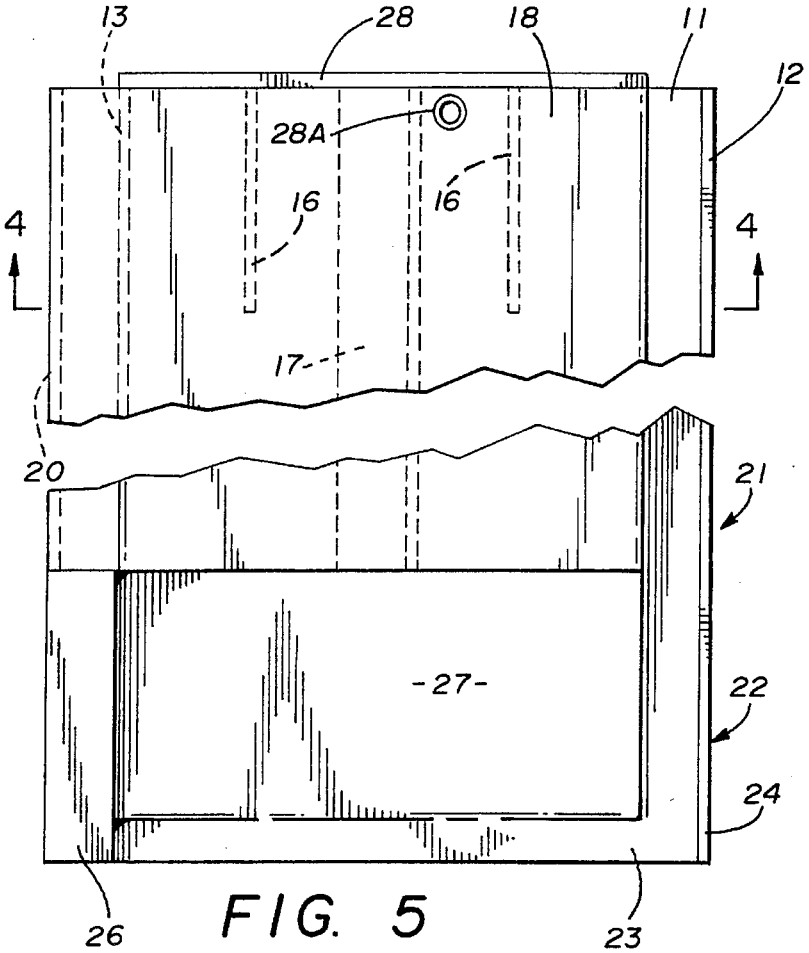
FIG. 5 is an enlarged side elevational view of a sheeting panel with portions broken away.
Figure 6:
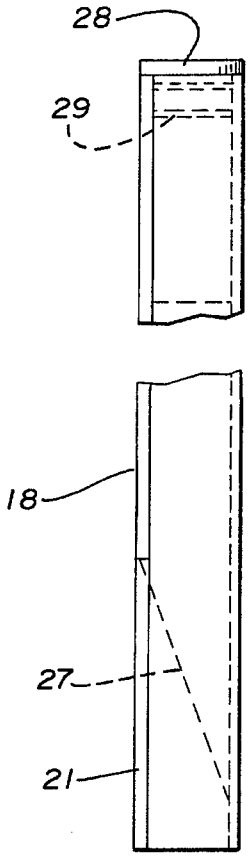
FIG. 6 is a side elevational view of the sheeting panel of the invention shown in FIG. 5.

A secondary support element 18 (best seen in FIG. 2 of the drawings) has a generally elongated matching rectangular configuration with oppositely disposed downturned longitudinally extending sidewalls 19 and 20 positioned for overlapping offset relation (see broken lines in FIG. 2 of the drawings) with the base supporting element 11 forming an enclosed panel section 21 of the invention having exposed respective sidewalls 20 and 12 as best seen in FIGS. 3 and 4 of the drawings.

A ground engaging knife panel portion 22 is fabricated independently of the assembled panel section 21 and defines a base panel 23 having upstanding sidewalls 24 and 25 and an angular offset flange 26 on said sidewall 25.

Figure 2:
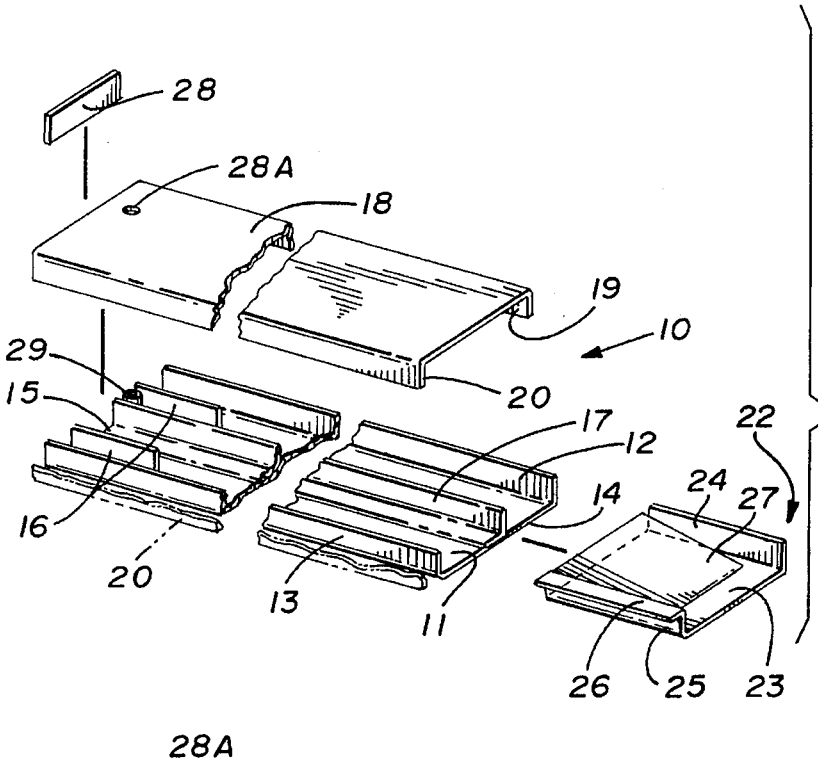
FIG. 2 is an enlarged exploded perspective view of a sheeting panel of the invention.

A tapered portion 27 is formed between said upstanding sidewalls inwardly from one end of said base panel 23 as seen in FIGS. 2 and 3 of the drawings. The completed panel portion 22 is secured to the end 14 of the panel section 21.

A rectangular generally flat pounding plate 28 is secured to the opposite end 15 of the panel section 21 completing the assembled sheet panel 10 of the invention as best seen in FIGS. 1, 3, 5 and 6 of the drawings.

Aligned circular apertures and inserts 28A respectively are formed in the respective base supporting elements 11 and 18 to provide a lifting insert point for the completed sheeting panel 10 of the invention as will be well known to those skilled in the art.

Figure 7:
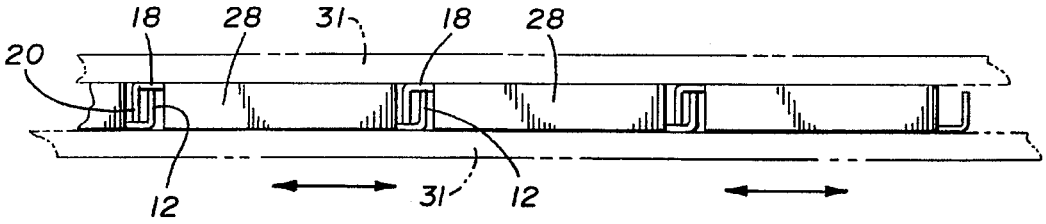
FIG. 7 is an enlarged top plan assembly view of the interengaging sheeting panels of the invention.

Referring now to FIGS. 1 and 7 of the drawings, the sheeting panel 10 is shown in use to form a trench box assembly 30 having a pair of guide frames 31 secured in spaced parallel relation to one another by multiple spreader members 32 on the respective ends as will be well known and understood by those skilled in the art.

Each of the guide frames 31 define a pair of elongated apertured frame sections secured to one another to form a panel guide channel 33 therebetween.

In use, the individual sheeting panels 10 are driven downwardly within the guide channels 33 in overlapping relationship as illustrated in FIG. 7 of the drawings with the respective sidewalls 12 and 20 being in overlapping engagement in repeating sequential relation between each of the adjoining sheeting panels 10. This arrangement allows for lateral adjustment of the panels while maintaining a secure interlocking sheeting wall within the respective guide frames 31 as hereinbefore described.

The sheeting panels are sequentially positioned and driven downwardly within the guide frames 31 as illustrated in FIG. 1 of the drawings in solid and broken lines.

It will be apparent to those skilled in the art that various changes and modifications may be made therein without departing from the spirit of the invention.

Therefore I claim:

1. A apparatus for constructing modular trench box sheeting panels comprising; elongated panel sections, each of said panel sections having oppositely disposed upstanding longitudinally extending sides, a plurality of reinforcing plates extending from one of said panels, said elongated panel elements secured to one another and to said reinforcing plates in transverse offset overlapping relationship defining oppositely disposed panel engagement channels between said respective upstanding sides, and said channels are open along their longitudinal length in opposing directions to one another, a ground engaging panel portion secured to one end of said elongated panels, said ground engaging portion comprising a base panel having oppositely disposed upstanding sidewalls, a taper portion on said base spaced inwardly from one of said sidewalls and inwardly from its free end thereof, a pounding plate secured to the panel portions end's reinforcing plates, and means for engaging said sheeting panel.

2. The apparatus for constructing modular trench box sheeting panels of claim 1 wherein said reinforcing plates extending between said elongated panel sections are spaced inwardly from one another.

3. The apparatus for constructing modular trench box sheeting panels of claim 1 wherein a trench box comprises pairs of guide frames secured in spaced relation to one another by multiple spreader members, said guide frames defining guide channels therebetween for removable overlapping registration of said sheeting panels within.

4. The apparatus for constructing modular trench box sheeting panels of claim 1 wherein said means for engaging said panels comprises aligned apertures in said panel sections, a tubular insert between said panels, said tubular insert aligned with said respective apertures therein.

5. The apparatus for constructing modular trench box sheeting panels of claim 1 wherein one of said reinforcing plates is of an angle configuration that extends the length of said panel sections between said pounding plate and said ground engaging panel portion.

6. The apparatus for constructing modular trench box sheeting panels of claim 1 wherein said panel engagement channels are interengageable to one another along their respective oppositely disposed panel engagement channels open longitudinal surfaces.

7. The apparatus for constructing modular trench box sheeting panels of claim 1 wherein said base portion of said sidewalls ground engaging panel portion defines initial ground engagement of said sheeting panels.

* * * * *